United States Patent [19]

Hough et al.

[11] Patent Number: 4,636,156

[45] Date of Patent: Jan. 13, 1987

[54] SCREW ROTOR MACHINES WITH SPECIFIC TOOTH PROFILES

[75] Inventors: David Hough, Marlow; Sidney J. Morris, Aylesbury; Anthony D. Barber, Truro, all of England

[73] Assignee: Compair Broomwade Limited, High Wycombe, England

[21] Appl. No.: 738,851

[22] Filed: May 29, 1985

[30] Foreign Application Priority Data

May 29, 1984 [GB] United Kingdom ..... 8413619

[51] Int. Cl.[4] ..... F04C 18/16

[52] U.S. Cl. ..... 418/201; 418/150

[58] Field of Search ..... 418/150, 201

[56] References Cited

U.S. PATENT DOCUMENTS

| | | | |
|---|---|---|---|
| 3,314,598 | 4/1967 | Lysholm | 418/150 |
| 3,432,089 | 3/1969 | Schibbye | 418/201 |
| 4,406,602 | 9/1983 | Kasuya | 418/201 |
| 4,435,139 | 3/1984 | Astberg | 418/201 |
| 4,460,322 | 7/1984 | Schibbye | 418/201 |

FOREIGN PATENT DOCUMENTS

| | | |
|---|---|---|
| 0106912 | 5/1984 | European Pat. Off. . |
| 1401422 | 10/1968 | Fed. Rep. of Germany . |
| 2903969 | 8/1980 | Fed. Rep. of Germany . |
| 2330888 | 6/1977 | France . |
| 1197432 | 7/1970 | United Kingdom . |

*Primary Examiner*—John J. Vrablik
*Assistant Examiner*—Jane E. Obee
*Attorney, Agent, or Firm*—Cushman, Darby & Cushman

[57] ABSTRACT

A screw rotor machine for compressing air or other working fluid comprises a housing including two intersecting bores axes which together define a working space. The pair of intermeshing rotors are rotatably mounted one in each bore. The rotors have helical lands and intervening grooves whereby rotation of the rotors in connecting engagement is effective to compress the working fluid (or to expand the fluid if the machine is used as an expander). A low pressure port and a high pressure port formed in the housing at opposite ends thereof permits inlet and outlet of the working fluid. The grooves of the rotors each have a primary flank and a secondary flank. The tips of the primary flanks of both the male and female rotors are formed by parabolic arcs which generate major portions of one of the flanks of the opposite rotors. A major portion of the secondary flank of the female rotor is also a parabolic arc.

32 Claims, 8 Drawing Figures

10
11
12
13
14
16
2
2
19
20
24
25
25

SCREW ROTOR MACHINES WITH SPECIFIC TOOTH PROFILES

The present invention relates to screw rotor machines which are particularly used for the compression of a working fluid and more particularly to the profiles of the rotors of such machines.

Screw rotor machines for the compression (or expansion) of an elastic working fluid are known and generally comprise a casing defining a working space consisting of two intersecting bores with parallel axes. The casing also includes spaced apart low pressure and high pressure ports communicating with the working space and with respective low pressure and high pressure channels. A pair of intermeshing rotors are disposed in the bores of the working space, each rotor having helical lands and intervening grooves with a wrap angle which is usually less than 360°. A pair of communicating groove portions of intermeshing rotors form a chevron-shaped chamber having a base end disposed adjacent to the high pressure port while its apex moves axially as the rotors rotate to vary the volume of the chevron-shaped chamber. A pair of rotors is one of male type where the lands of the rotor, or a significant proportion thereof, lie outside the pitch circle of the rotor and the other of female type where the lands and grooves of the rotor, or at least a major proportion thereof lie inside the pitch circle of the rotor.

Such machines are well-known and it is also well-known that the efficienty of such machines depends to a very great extent on the profiles of the rotors.

The efficiency of such machines is influenced by the size of the so called blow-hole and the length and width of the sealing lines separating the chevron shaped compression chamber from the surrounding lower pressure zones. The blow-hole, which is formed as the rotors rotate in and out of engagement occurs on both the low and high pressure sides of the rotors and allow leakage of the working fluid to escape from the compression space.

In the usual case where such machines are driven through the male rotor, the torque on the female rotor also affects the sealing characteristic of the machine and therefore its efficiency.

Power losses due to discharge inefficiences are influenced by the size of the discharge port and consequently by the number of lands on the rotor, the helix angle and the length of the rotor.

The so called "trapped pockets" also have an adverse affect on power consumption and bearing life. On some prior art designs the affect is so great that machines have to be modified in order to ensure adequate draining of these trapped pockets.

Losses associated with the shearing action of the oil lubrication film are also influenced by profile geometry and specifically by the number of land combinations used in the design. Some designs incorporate extra flutes which, for part of the cycle, carry out no function in regards to compressing the working fluid. The presence of an additional flute increases the losses associated with viscous drag and therefore reduces the efficiency.

There are many prior art specifications describing machines of the above kind and it has become evident in recent years that machines of greater efficieny are produced when asymmetric rotor profiles are used, that is profiles in which each rotor groove is asymmetric about a radial line drawn from the axis of the rotor through a point at the lower most part of the groove. Examples of screw rotor machines with asymmetric profiles are shown in British Patent Specifications Nos. 1197432 and 2092676. Both these specifications describe machines in which the rotors have asymmetric profiles and are also designed so that the female rotor lands have an addendum (that is a portion extending outside the pitch circle of the female rotor) while the male rotor grooves have a dedendum (that is a portion extending inside the pitch circle of the male rotor).

The inclusion of the addendum and resulting dedendum portions increases the volume of the working space and provides improved drive conditions when drive to the machine is provided through the female rotor. The main disadvantage of the addemdum is that the blow-hole referred to above is increased in size.

The size of the blow-hole is also influenced by the length of the male and female rotor tip generators in line generated profiles.

Another significant factor in screw rotor machine profile design is the cost of manufacture of the rotor profiles.

The cost of screw rotor machines for a stated output is directly influenced by physical size, ease of manufacture and tooling wear characteristics.

For example the cost is affected by the number of rotor lands selected for the design and the geometry of the profile. Some rotor designs require that the rotors be matched and synchronised in order to achieve optimum performance thereby increasing the cost of the rotor pair.

Sealing strips incorporated in some designs require separate machining operations which increases the cost of rotor manufacture but also contributes to a reduction in efficiency.

Pressure angles influence both cost and performance and in earlier designs zero pressure angles produced ideal drive conditions but resulted in very poor cutting characteristics for the hob-milling process.

Profile geometry also affects cost. Profiles with radical changes in curvature and unevenly distributed cutting loads are very difficult to produce.

For example, the rotor profiles described in British Patent Specification No. 1197432 have been found to have the disadvantage that the discontinuities of slope in those profiles result in the angle between the two flanks of a male rotor groove at the pitch circle being so small that a tool used for the production of such a rotor must have substantially parallel edges adjacent its tip. This means that it is impractical to produce such a profile by, for example a hob milling process because, as the tool wears, the regrinding necessary to produce the correct tool shape is excessive and the life of the tool correspondingly reduced.

This problem is discussed in British Patent Specification No. 1503488 which provides a partial solution to the problem of designing rotor profiles which are relatively simple to machine. However, the profiles described in British Patent Specification No. 1503488 result in the lands of the female rotor being reduced in thickness and thereby weakened. It had hetherto been thought that such weakening of the lands would result in a machine which would not operate satisfactorily.

A number of the prior art specifications have described rotor profiles in which a fixed point defined on one rotor has been used as the generator for part of the profile of the other rotor. Such point generation has also been found to have disadvantages in that it is extremely difficult accurately to fix a point on a rotor profile.

In addition the point generated seal line is vulnerable to wear and damage.

Accordingly, attempts have been made to provide improved screw rotor machines by the use of profiles in which arcuate flank portions of one sort or another have been used as the generators for portions of the profiles of the corresponding rotors. For example in British Patent Specification No. 2092676 referred to above and also in No. 2112460, profiles are described in which circular arcs are used as the generators.

In British Patent Specification No. 2106186, an elliptical arc and involute curve are used as the generators. These various profiles have gone some way towards improving one or more of the features referred to above which have an effect on the efficiency of the machine but none of the arrangements described has resulted in a machine which combines high efficiency with a high volumetric flow relative to the size of the rotors and relatively low manufacuring costs.

In one aspect, the invention provides a pair of intermeshing rotors having helical lands and intervening grooves and being rotatable, in use, in the housing about parallel axes for coacting engagement to alter the pressure of working fluid, the grooves of each rotor each having a primary flank and a secondary flank and characterized in that at least the first portion of one of the flanks of each rotor is a parabolic arc.

Preferably one of said parabolic arcs is a minor portion of the primary flank of a male rotor having at least major portion of its helical lands lying outside a pitch circle of the rotor. Preferably the other said parabolic arc is a minor portion of the primary flank of a female rotor having at least the major portion of at least the major portion of its helical lands lying inside the pitch circle of the rotor. In a preferred embodiment, the parabola parameters of the two said parabolic arcs are equal.

The invention further provides a screw rotor machine for a working fluid comprising a housing including two intersecting bores with parallel axis together defining a working space within the housing, a pair of intermeshing rotors rotatably mounted one in each bore, a low pressure port and a high pressure port formed in the housing at spaced locations and communicating with the working space for inlet and outlet of working fluid from the machine in which the pair of rotors are as described above.

Preferably, one rotor has four lands and the other rotor has five lands.

Further features and advantages of the invention will be apparent from the following description by way of example of a preferred embodiment of the invention, the description being read with reference to the accompanying drawings, in which.

Figure 1:
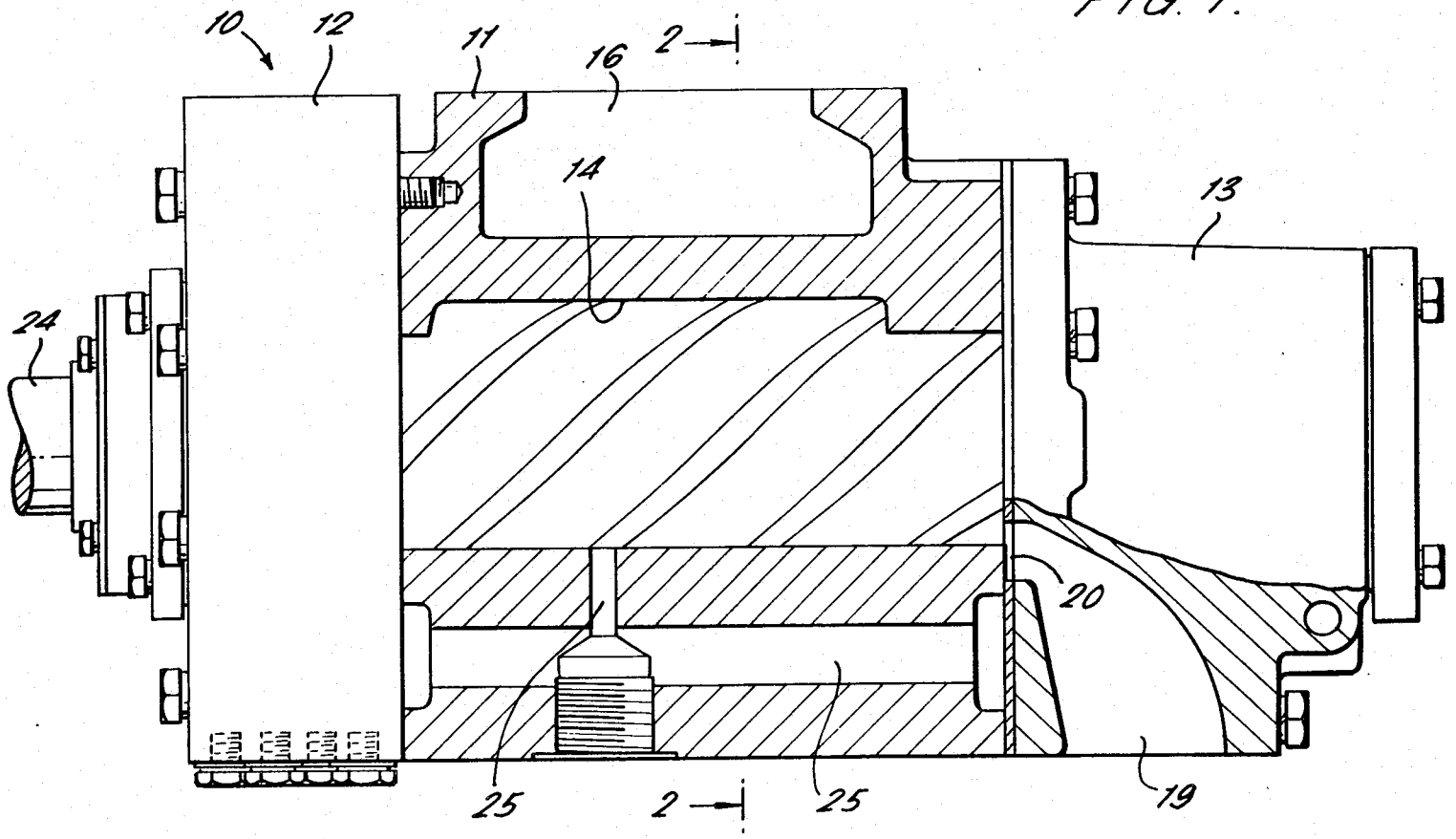
FIG. 1 is a longitudinal view of a screw compressor, partly in section, the section being along the line 1—1 of FIG. 2.
Figure 2:
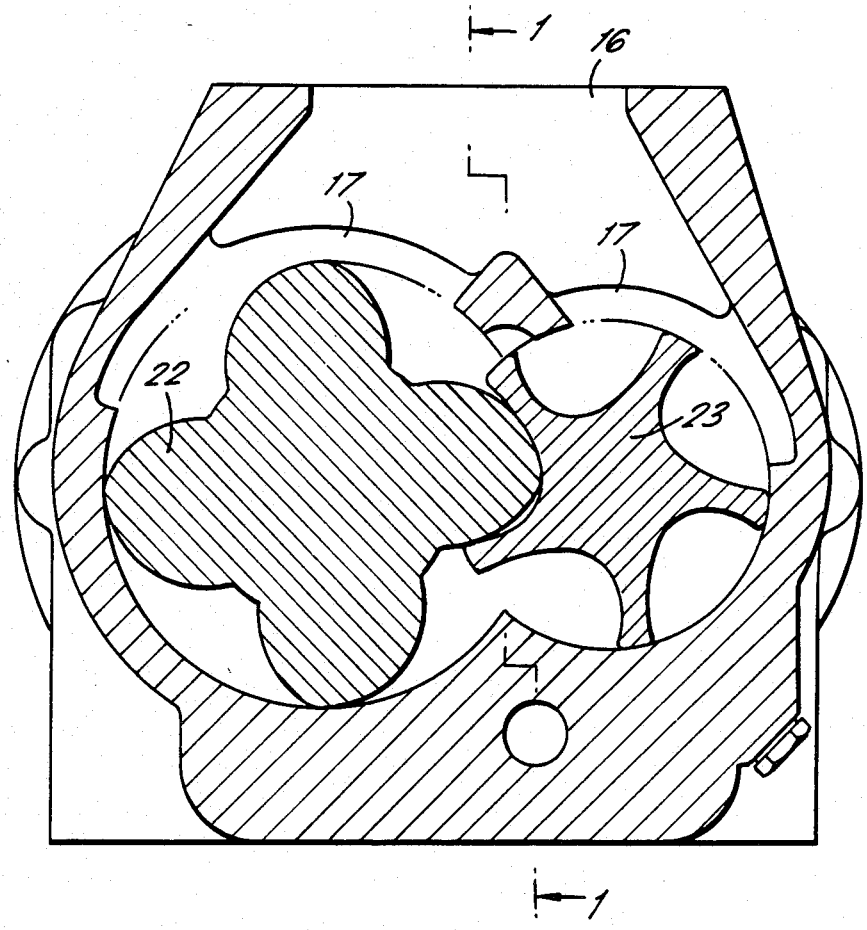
FIG. 2 is a transverse section through the compressor, along the line 2—2 of FIG. 1.

Referring first to FIGS. 1 and 2 a screw compressor 10 comprises a casing formed in three main sections, a central section 11 and end sections 12, 13. The central casing section 11 defines a working space 14 which is in the form of two intersecting cylindrical bores having parallel axes. As can be seen from FIG. 2, the diameter of these bores is unequal. The central casing section 11 is further provided with a low pressure channel 16 which communicates with the working space 14 via inlet ports 17.

The right hand end casing section 13 includes a high pressure channel 19 which communicates with the working space 14 of the compressor via an outlet port 20. As can be seen from FIGS. 1 and 2, the low pressure port 16 is located in the casing side wall and entirely on one side of a plane containing the axes of the two intersecting bores. The high pressure port 19 is located in an end wall of the working space 14 and entirely on the other side of the plane containing the axes of the intersecting bores opposite to the low pressure port.

Within the working space 14, there are located two cooperating rotors, a male rotor 22 and a female rotor 23. As can be seen in FIG. 2 the rotors are in intermeshing relationship and are located with their axes coinciding with the axes of the intersecting bores of the working space 14. The rotors are journalled in bearings provided in the casing end sections 12, 13 but not shown in FIG. 1. These bearings are of known type. The male rotor 22 further includes a shaft 24 projecting from casing end section 12. The shaft 24 is, in use, connected directly or through a speed adjusting device to a prime mover to drive the compressor.

The rotors 22, 23 are lubricated as they rotate by oil fed into the working space 14 through channels 25 formed in the casing.

Each rotor 22, 23 has helical lands and intervening grooves with a wrap angle of less than 360°. The arrangement and profiles of these lands and grooves will be described in more detail below. As is well known in screw compressors a pair of communicating grooves form a chevron-shaped chamber having its base end disposed in a fix plane tranverse to the rotor axes and adjacent to the outlet port 20. The apex of the chevron-shaped chamber moves axially as the rotors rotate to vary the volume of the chamber and thereby compress working fluid introduced to the chamber via low pressure channel 16 and inlet ports 17.

It will be appreciated that the terms "inlet" and "outlet" are used to refer to the arrangement when the working fluid is being compressed by passage through the compressor from the low pressure channel 16 to the high pressure channel 19. However, it will be appreciated that the function of these ports will be reversed if the machine is instead used as an expander.

Figure 3:
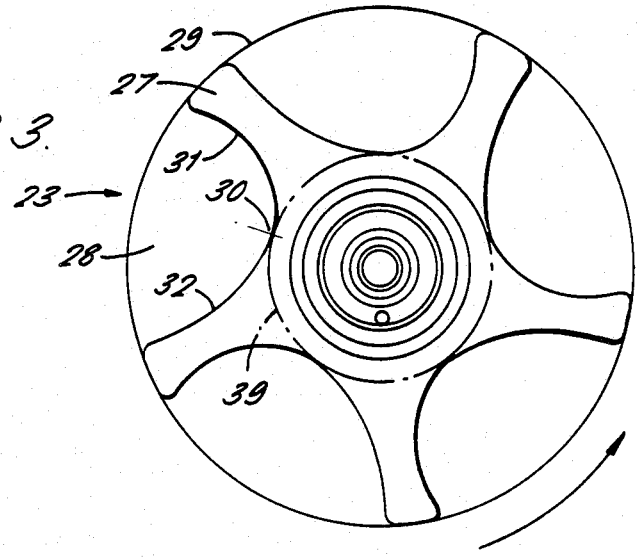
FIG. 3 is an end view of one of the intermeshing rotors of the compressor of FIGS. 1 and 2 (the female rotor)

Turning now to FIG. 3, the female rotor 23 is shown. The rotor 23 includes five helical lands 27 defining therebetween five helical grooves 28. The pitch circle of the rotor is shown at 29 and it will be seen that the lands 27 do not extend beyond the pitch circle, that is to say the rotor does not include addendum portions of the lands.

It will also be seen in FIG. 3 that the grooves 28 are asymmetric about a radial line drawn through their inner most point 30. Each groove has a primary flank 31 on one side of its inner most point 30 and a secondary flank 32 on the other side. The profiles of these primary and secondary flank portions will be described in more detail below with reference to FIG. 5.

Figure 4:
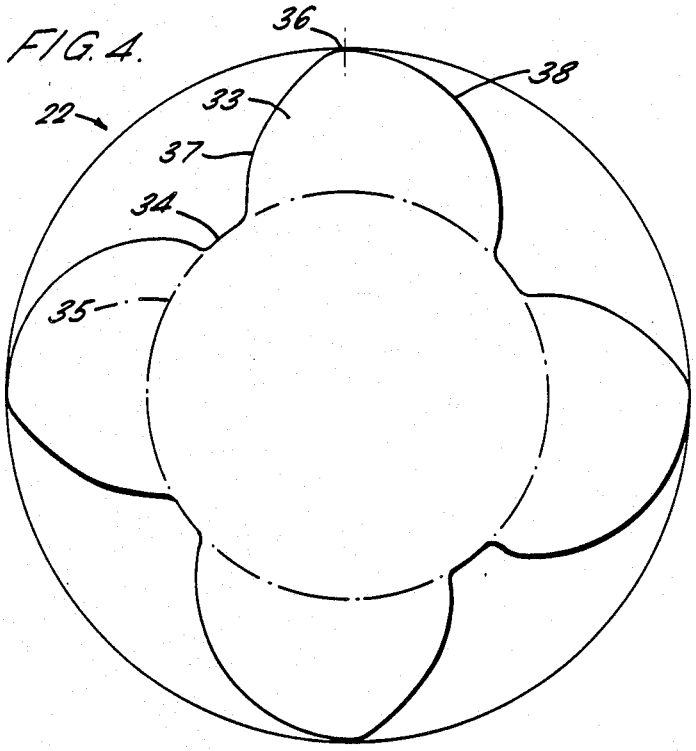
FIG. 4 is a view similar to FIG. 3 of the other rotor of the compressor (the male rotor)

Turning now to FIG. 4, the male rotor 22 comprises four helical lands 33 defining between the intervening grooves 34. The pitch circle of the male rotor is shown at 35 and it will be seen that the inner most portions of the grooves 34 lie on the pitch circle 35 and do not extend within the pitch circle that is to say there is no dedendum on the male rotor grooves. Each land 33 of the male rotor is asymmetric about a radial line drawn from the axis of the rotor through the tip 36 of the land and has a primary flank portion 37 lying on one side of the said line and a secondary flank portion 38 lying on the other side. Again, the profiles of the primary and secondary flanks 37, 38 will be described in more detail below with reference to FIG. 5.

It will be appreciated from a comparison of FIGS. 2, 3 and 4 that the provision of five lands on the female rotor and four on the male rotor means that the female rotor is rather smaller than is the case when the more usual land configuration of six female and four male is adopted. It will also be seen that the root diameter of the female rotor is considerably smaller than the root diameter of the male rotor and in the compressor shown, these root diameters are approximately in the ratio of 9 to 16. The diameters of the pitch circles 29, 35 are in the ratio 5:4.

These ratios, together with other geometric features which will be described later, provide a displacement at a performance level which was hitherto not considered possible.

Figure 5:
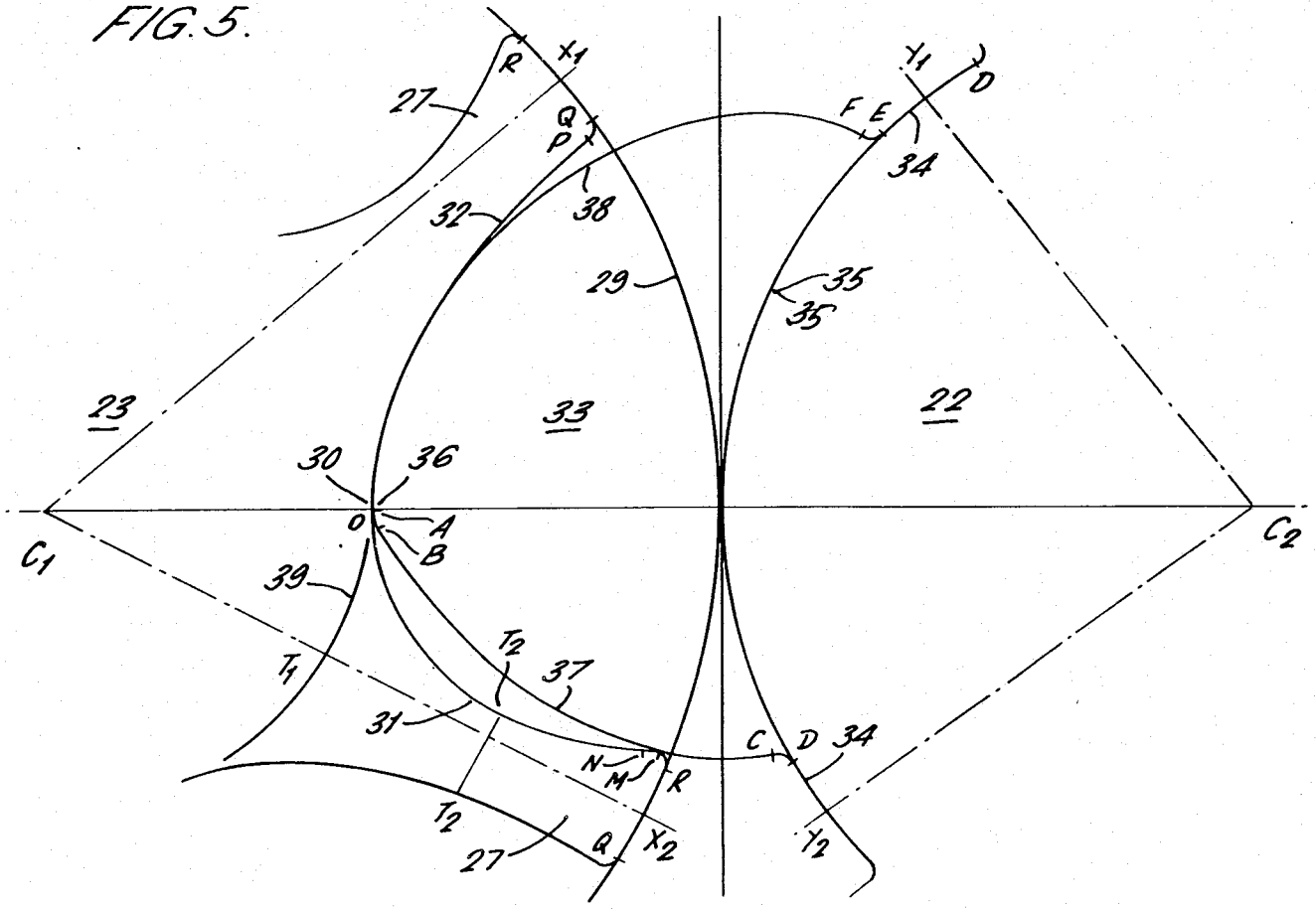
FIG. 5 is an enlarged view of part of the rotors of FIGS. 3 and 4 showing their interrelationship and the geometry of their profiles.

Turning now to FIG. 5, there is shown a single land 33 of the male rotor 22 in mesh with a groove 28 of the female rotor 23. The rotors are shown in the position of rotation where the tip 36 of the male rotor land is in contact with the point 30 on the female rotor groove. The points 30 and 36 are then co-incident and on the line, joining the centres C1, C2 of the two rotors. The midpoints of adjacent lands of the female rotor are shown at X1, X2 and it will be appreciated that the angle between lines C1-X1 and C1-X2 is 72°. The mid points Y1, Y2 of adjacent male rotor grooves are also shown and it will be appreciated that the angle between lines C1-Y1 and C2-Y2 is 90°.

It will be immediately apparent from an examination of FIG. 5 that the profiles of the male and females rotors are composed of a number of curved segments. These segments, which will be described in more detail below, are chosen so that the tangents at the intersections of adjacent segments are always equal in order to ensure that there are no discontinuities between adjacent profile segments.

Considering first the male rotor 22, the primary flank of the land 33 consists mainly of a first minor flank portion AB and a second major flank portion BC. The point A is co-incident with the tip 36 of the male rotor land. The secondary flank 38 of the male rotor land 33 consists mainly of a major flank portion FA. The male rotor groove 34 consists of a single arcuate portion DE. The primary 37 and secondary 38 flanks of the male rotor land are linked to adjacent grooves by minor flank portions CD, EF respectively.

Considering these flank portions in order, portion AB is a parabolic arc having its origin at point A which is co-incident with the male rotor tip 36 and extending from A to B according to the parabola equation $Y^2=4K1X$ where K1 is a parameter of the parabolic arc AB. The flank portion BC is the epitrochoidal envelope or curve generated, as the rotors rotate by the path of a portion MN of the female rotor primary flank 31 which will be described in more detail below.

The male rotor secondary flank portion FA is again an epitrochoidal envelope or curve generated by the movement of a portion of the female rotor groove as the rotors rotate. In this case, the generator is a portion OP of the female rotor secondary flank which will be described in more detail below.

The male rotor groove flank portion DE is a circular arc centred on C2 and co-incident with the pitch circle of the male rotor. The minor flank portions CD and EF are generated by the circular arc portions PQ and RM of the female rotor 23, such that the slopes of the portions CD, EF match those of adjacent portions BC, DE, FA as described above.

Considering now the female rotor 23, the primary flank 31 of the female rotor groove consists mainly of a first minor flank portion MN and a second major portion NO. The female rotor groove secondary flank 32 consists mainly of a single major flank portion OP. The female rotor lands 27 have their tips defined by a flank portion QR and the lands are linked to adjacent grooves by minor flank portions PQ, RM.

Taking these flank portions in turn, the first minor flank portion MN of the female groove primary flank 31 is again a parabolic arc extending from M to N according to the parabola equation and having a parameter K2. The parameter K2 is equal to the parameter K1 of the male rotor tip parabola AB.

The female rotor groove primary flank portion NO is a epitrochoidal envelope or curve generated by the movement of the male rotor tip parabola AB as the rotors rotate. This extends to the point O which is co-incident with point 30 at the inner most point of the female rotor groove 28.

In FIG. 5, there is shown a single land 27 of the female rotor 23 and a secondary flank 32 of that rotor has its major portion OP defined by the equation of $y2=4K3X$ where K3 is a parameter of the parabolic arc OP.

In the compressor shown the parameter K3 is in a ratio of approximately 8:1 with the parameters K1 and K2. The value of K3 results in a displacement of the rotor profile which is maximum for the specific flute thickness specified which in turn provides adequate stiffness for the levels of clearances employed in the design.

The specific flute thickness is defined as the width of the female land at a plane at approximately the midpoint of its depth expressed as a percentage of plate depth.

This is illustrated as an approximation by lines T2 T3 and T1 X2 in FIG. 5. The specific flute thickness for the compressor shown is approximately 28%.

The other advantages resulting from the selection of the valve of K3 in $y^2=4K3X$ will be described later.

The female rotor land portions QR are circular arcs centred on C1 and co-incident with the pitch circle 29 of the female rotor. The minor flank portions PQ and RM are also circular arcs, the centres and radii of which are chosen to ensure that the slopes of the portions PQ, RM where they meet adjacent portions MN, OP, QR are the same, as described above. This condition is achieved by portions PQ, RM having equal radii and it will be appreciated that the minor flank portions EF, CD, of the male rotor are generated by the female rotor minor portions PQ RM.

It will be appreciated from the above description of the rotor profiles that all the generated portions of both male and female rotor profile are line generated rather than point generated. As described above, the generators for all the major generated portions of the rotor profiles are parabolic arcs and this results in important improvements in the sealing characteristics of the compressor as will be explained in more detail below.

Figure 6:
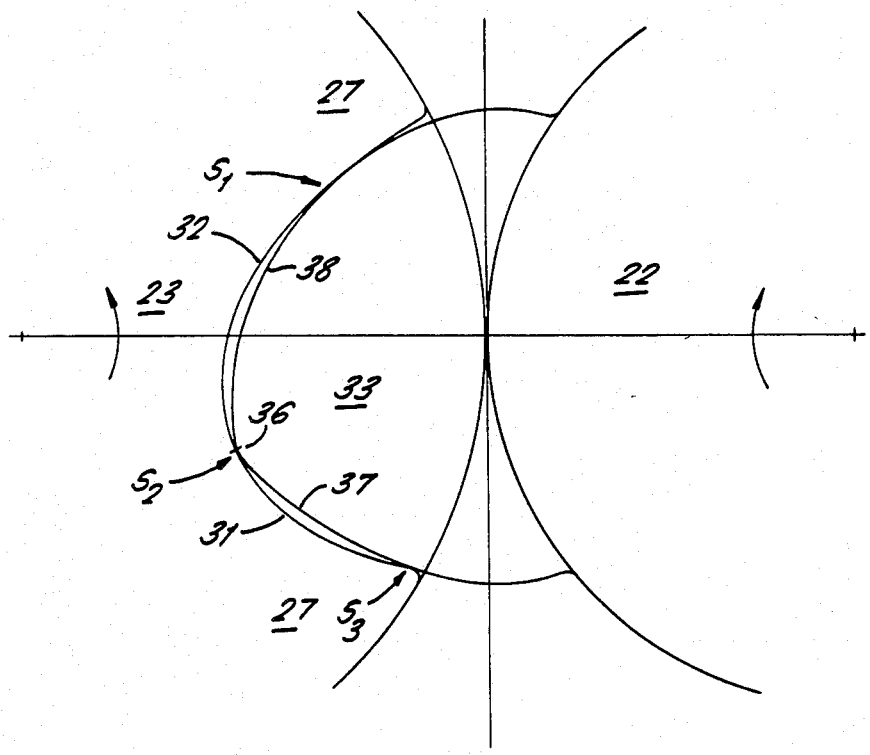
FIG. 6 is a view similar to FIG. 5 but with the rotors rotated relative to one another by approximately 10°.
Figure 7:
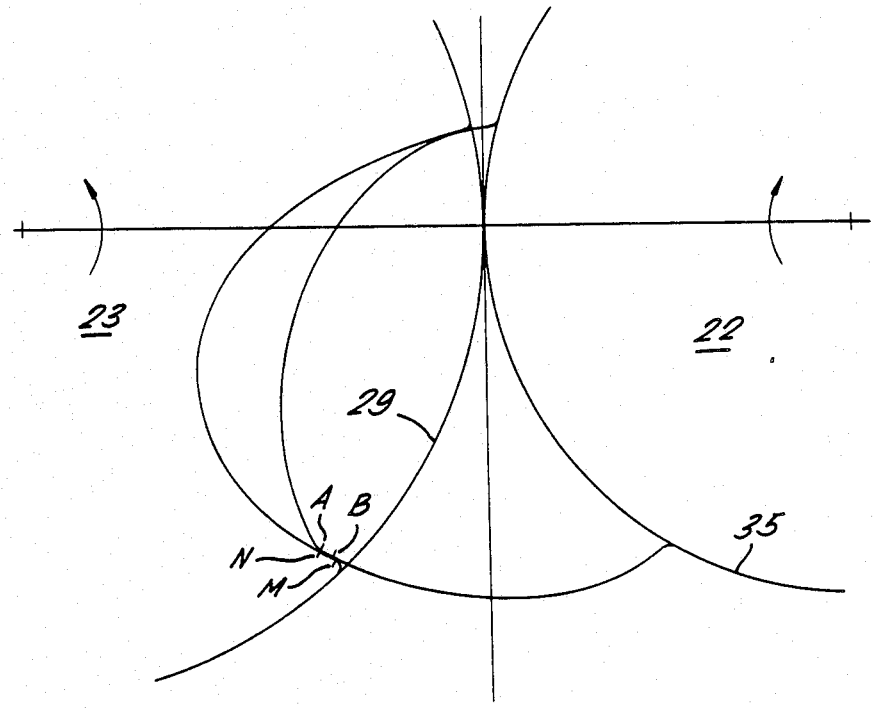
FIG. 7 is a view similar to FIGS. 5 and 6 but with the rotors rotated through 30° relative to the position of FIG. 5.

Referring now to FIGS. 6 and 7, the portions of male and female rotor shown in FIG. 5 are again illustrated but with the male rotor rotated relative to the female rotor by 10° (FIG. 6) and 30° (FIG. 7) respectively.

FIG. 6 illustrates the effect on the sealing characteristics of the compressor of the parabolic line generation of the rotor profile described above. It will be seen in FIG. 6 that there are three portions of the rotor profiles which make sealing contact at S1, S2, and S3. S1 is the sealing band formed between the female rotor secondary flank and the male rotor secondary flank. S2 is the sealing band provided by the interengagement of the male tip parabola AB with the female flank portion NO and S3 is the sealing band provided by the engagement of the female tip parabola MN with the male flank portion BC. In the arrangement shown when the machine is acting as a compressor the sealing bands S2, S3 are on the trailing flanks of the rotors but the arrangement is such that the air pressure within the fluid space of the female rotor produces a negative torque on the female rotor as the male rotor drives the compressor. This has the effect of urging the flank portions at S2 and S3 together to ensure good sealing bands at those positions. As can be seen from FIG. 6, the sealing band at S1 is rather wider than those at S2 and S3 and therefore serves to provide a satisfactory sealing condition despite the negative female rotor torque described above which has the effect of urging the flanks at S1 apart.

In addition, because the seal line lengths of S2 and S3 are approximately 50% longer than the seal line length of S1 it is more important to close S2 and S3 so that the leakage area of both sides is approximately equal.

Turning now to FIG. 7, the drawing illustrates the position of rotation of the rotors in which the male tip parabola AB just makes contact with the female tip parabola MN. Any further rotation of the rotors will break the contact between the respective male land and female groove shown. In the position shown in FIG. 7, the slopes of the male and female tip parabolas are identical and both parabolas act towards their origin.

As is well known in screw compressor technology a blow-hole or leakage triangle is formed where the rotors disengage which effectively represents a break on the inter lobe seal line. The size of the blow-hole is goverened by the length of the parabolas AB and MN, the value of the parameters K1 and K2, and the size of the female lands tip radius on the primary flank.

The combination and nature of the two parabolas AB and MN are such that the resulting area of the blow-hole under optimum operating conditions, does not exceed 3 $mm^2$ per liter of air displaced while at the same time providing the band width necessary to improve the sealing performance of the most critical sealing lines 52 and 53.

It will be appreciated that the arrangement of parabolas AB and MN as described above ensures that leakage is kept to a minimum. Since the parabolas have equal slope and both act towards their origins, this ensures that the contact between the parabolas in the position shown in FIG. 7 is between those parts of the parabolas having least curature, hence greatest contact length and lower leakage potential.

Figure 8:
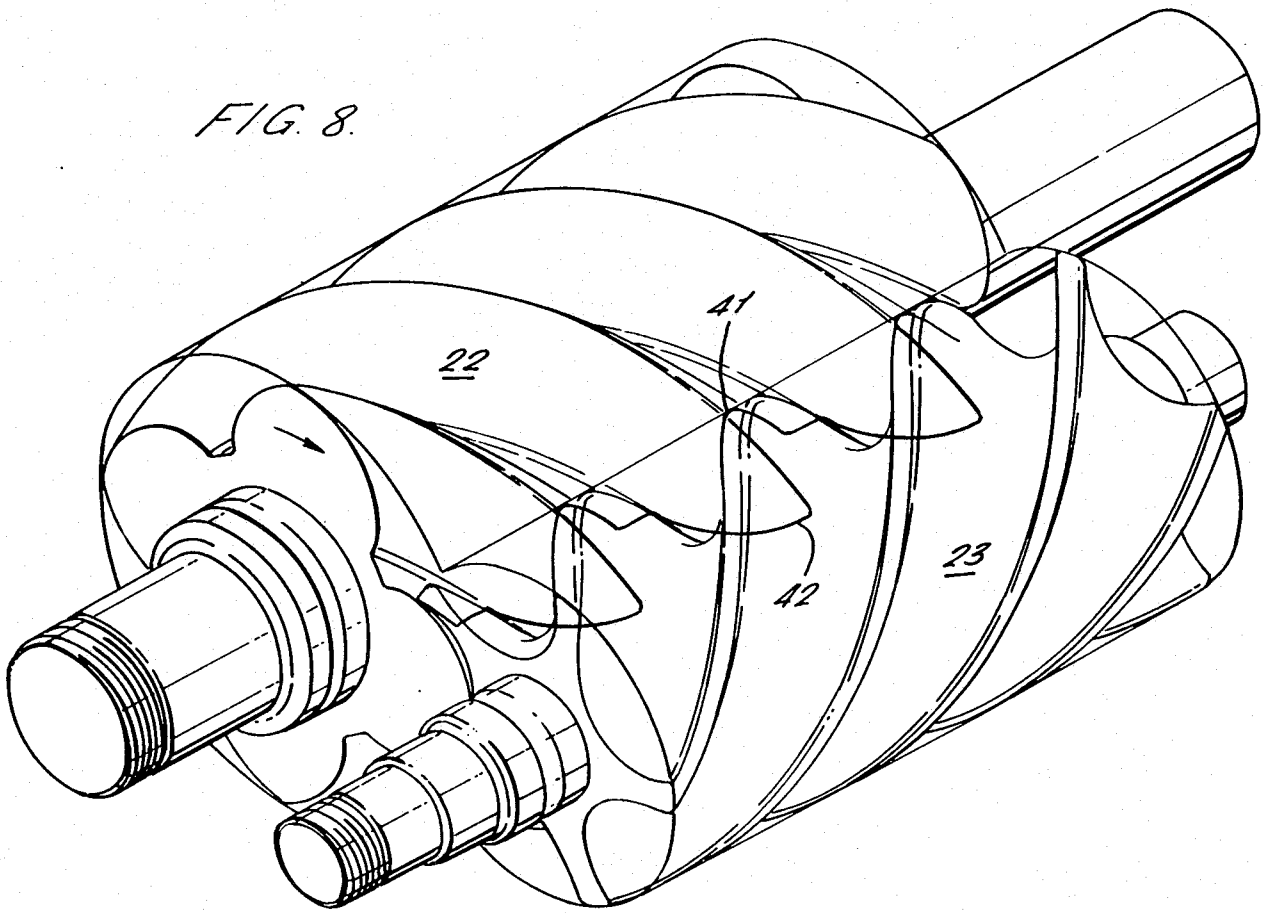
FIG. 8 is a perspective view of the two rotors in intermeshing relationship showing the seal line between the rotors.

FIG. 8 illustrates the positions of the blow-hole 41 and also illustrates the mesh seal line 42 between the two rotors. The blow hole 41 is very much smaller than is customary in known compressors while, as already described above, the width of the sealing bands is substantial.

The combination of line generation of rotor profiles, the use of parabolic arcs as line generators, the provision of major portions of the flanks with smooth and continuous radius of carvature from root to tip without points of inflexion and the combination of a female rotor with five lands and a male rotor with four lands provides a number of significant advantages.

A first and very important one of these is that the volumetric efficiency of the compressor is high. The factors which contribute towards this high volumetric efficiency are the good sealing characterics described above both in terms of the size of the seal bands and the negative female rotor torque which tends to close the trailing edge sealing points, and the greatly reduced blow-hole area.

A second and significant advantage is that the compressor described provides a much larger displacement for a given size of rotors at performance levels which hitherto were not considered possible.

This results from the unique geometrical ratios already defined and the land combinations chosen.

For example the size of the compressor incorporating this invention is approximately 22% smaller than that described in No. 2092676 for optimum operating conditions.

A third advantage stemming from the land configuration chosen is that the need for preselection of the synchronisation of the flutes is eliminated. It will be appreciated that for the more usual combination of six female lands to four male lands, the same two male lands always mesh with the same three female grooves as the rotors rotate. Change in performance will result from engagement of two given male rotor lands with a different set of three female grooves. Optimum performance can only be achieved by carefully selecting the best mesh configuration which inevitably means that the cost increases. In the compressor described above, each male rotor land engages in turn with each female groove and performance is therefore unaffected by the relative orientations of the two rotors.

A fourth advantage is the elimination of one land from the usual six female lands which means that the viscous drag associated with this land, and the resulting increase in power consumption, are eliminated. Thus enables the female land width to be advantageously increased and to more optimally match the sealing performance of the male rotor which operates at relatively higher tip velocities.

In addition the elimination of one land in the female rotor design results in an increase in the size of the discharge port for any given built in volume ratio which means a reduction in discharge port losses. This advantage is particularly beneficial at high pressure ratios.

Another significant advantage stemming from the improved volumetric efficiency described above is the reduction in power consumption per liter of air delivered.

In addition the value of the parameter K3 in the parabolic definition of the female secondary flank was selected to ensure that the so called trapped pocket condition, shown in FIG. 6 as the pocket between flank 32 and 38 produces a separating force which is much smaller than that which has occurred on some earlier designs.

The above described advantages all relate to the performance of the compressor. However, further advantages of the described compressor lie in the manufacturing process.

The first and most important of these is that the rotor profiles described above have no zero or negative pressure angles thereby eliminating the problems normally associated with machining the rotors by means of the hob-milling process.

The difficulties, extra costs and quality problems which result from attempting to machine rotors which unsatisfactory pressure angles, by the hob-milling process, are well understood and are discussed for example in British Patent Application No. 2092676.

The minimum pressure angle for the profile geometry defined is approximately 10°.

The second manufacturing advantage stemming from the compressor described relates to the parabola defined on the secondary flank of the female land. The parabola, defined by $y^2=4K3X$ as described above, provides a smooth and continuous radius of curvature from the root of the rotor, defined by point 30 in FIG. 5, to the tip of the female defined by point P.

The smoother shape produced by this parabola results in improved machining in distinction to the compressor described in British Patent Application No. 2092676.

Another significant factor in reducing manufacturing costs relates to the female rotor land configuration. On the more usual female rotor design there are six lands to machine whereas for the selected five female land configuration there are only five lands to machine.

A further advantage is that the improved sealing features of the compressor described above allow greater tolerances in the manufacturing process without adversely effecting the performance of the compressor.

We claim:

1. A pair of intermeshing rotors having helical lands and intervening grooves and being rotatable, in use, within a housing about parallel axes for co-acting engagement to alter the pressure of a working fluid, the grooves of each rotor each having a primary flank and a secondary flank in which at least a first portion of at least one of said flanks of each rotor is a parabolic arc.

2. A pair of rotors as claimed in claim 1 to in which both parabolic arcs have the same parabola constant.

3. A pair of rotors as claimed in claim 1 in which the female rotor lands lie inside the pitch circle of the rotor and the male rotor grooves lie outside the pitch circle of that rotor.

4. A pair of rotors as claimed in claim 1 in which one rotor has four lands and the other rotor has five lands.

5. A pair of rotors as claimed in claim 4 in which the four land rotor is a male rotor having at least a major portion of its lands lying inside a pitch circle of the rotor and the five land rotor is a female rotor having at least a major portion of its lands lying inside a pitch circle of the rotor.

6. In a screw rotor machine for a working fluid as claimed in claim 1 comprising a housing including two intersecting bores with parallel axes together defining a working space within the housing: a pair of intermeshing rotors rotatably mounted one in each bore, each rotor having helical lands and intervening grooves whereby rotation of the rotors in coacting engagement is effective to alter the pressure of the working fluid, a low pressure port and a high pressure port formed in the housing at spaced locations and communicating with the working space for inlet and outlet of working fluid from the machine.

7. A screw rotor machine as claimed in claim 6 in which the working fluid entering the machine through the low pressure port is compressed by rotation of the rotors and leaves the machine through the high pressure port.

8. A screw rotor machine as claimed in claim 6 in which the low pressure port is located on one side of a plane containing the axes of rotation of the rotors and the high pressure port is located on the other side of said plane.

9. A screw rotor machine as claimed in claim 6 in which one rotor has four lands and the other rotor has five lands.

10. A screw rotor machine as claimed in claim 9 in which the four land rotor is a male rotor having at least a major portion of its lands lying outside a pitch circle of the rotor and the five land rotor is a female rotor having at least a major portion of its lands lying inside a pitch circle of the rotor.

11. A screw rotor machine as claimed in claim 10 in which the male rotor includes a shaft extending from the housing for connection to driving means for the machine.

12. A screw rotor machine as claimed in claim 11 in which, in use of the machine with drive means connected to the male rotor shaft, a negative torque is produced on the female rotor.

13. A pair of rotors as claimed in claim 1 in which one is a male rotor having at least a major portion of the helical lands lying outside a pitch circle of the rotor and the other is a female rotor having at least a major portion of its helical lands lying inside a pitch circle of the rotor, one of said first flank portions extending from a tip of a land of the primary flank of the male rotor.

14. A pair of rotors as claimed in claim 13 in which a first minor portion of the primary flank of the female rotor is also a parabolic arc.

15. A pair of rotors as claimed in claim 14 in which a second major portion of the primary flank of the female rotor has an outline following the curve generated by a first minor portion of the male rotor primary flank.

16. A pair of rotors as claimed in claim 15 in which said major second flank portion of said primary flank of the female rotor extends outwardly towards the pitch cirlce and merges into said first minor portion of the primary flank of the female rotor.

17. A pair of rotors as claimed in claim 14 in which a major portion of the secondary flank of the female rotor is also a parabolic arc.

18. A pair of rotors as claimed in claim 17 in which a major portion of the secondary flank of the male rotor has an outline following the carve generated by said major portion of said secondary flank of the female rotor as the lands and grooves pass into and out of mesh when the rotors rotate.

19. A pair of rotors as claimed in claim 14 in which a second major portion of the primary flank of the male rotor has an outline following a curve generated by said first minor portion of the female rotor primary flank.

20. A pair of rotors as claimed in claim 19 in which said second major portion extends from adjacent the pitch circle of the male rotor and merges into a first minor portion of the male rotor primary flank.

21. A pair of rotors as claimed in claim 20 in which said first minor portion of the male rotor primary flank merges into said major portion of the male rotor secondary flank at the land tip.

22. A pair of intermeshing rotors having helical lands and intervening grooves and being rotatable, in use, within a housing about parallel axes for co-acting engagement to alter the pressure of a working fluid, the grooves of each rotor each having a primary flank and a secondary flank, one of said rotors being a male rotor having at least a portion of the helical lands lying outside a pitch circle of the rotor and the other being a female rotor having at least a major portion of its helical lands lying inside a pitch circle of the rotor, in which at least a first portion of at least one of said flanks of each rotor is a parabolic arc, one of said first flank portions extending from a tip of a land of the primary flank of the male rotor and the other said flank portion being a first minor portion of the primary flank of the female rotor.

23. A pair of rotors as claimed in claim 22 in which the female rotor lands lie inside the pitch circle of the rotor and the male rotor grooves lies outside the pitch circle of that rotor.

24. A pair of rotors as claimed in claim 22 in which a second major portion of the primary flank of the female rotor has an outline following the curve generated by said first minor portion of the male rotor primary flank.

25. A pair of rotors as claimed in claim 24 in which said second major flank portion of said primary flank of the female rotor extends outwardly towards the pitch circle and merges into said first minor portion of the primary flank of the female rotor.

26. A pair of rotors as claimed in claim 22 in which a major portion of the secondary flank of the female rotor is also parabolic arc.

27. A pair of rotors as claimed in claim 26 in which a major portion of the secondary flank of the male rotor has an outline following the curve generated by said major portion of said secondary flank of the female rotor as the lands and grooves pass into and out of mesh when the rotors rotate.

28. A pair of rotors as claimed in claim 22 in which one rotor has four lands and the other rotor has five lands.

29. A pair of rotors as claimed in claim 28 in which the four land rotor is a male rotor having at least a major portion of its lands lying inside a pitch circle of the rotor and the five land rotor is a female rotor having at least a major portion of its lands lying inside a pitch circle of the rotor.

30. A pair of rotors as claim in claim 22 in which a second major portion of the primary flank of the male rotor has an outline following a curve generated by said first minor portion of the female rotor primary flank.

31. A pair of rotors as claimed in claim 30 in which said second major portion extends from adjacent the pitch circle of the male rotor and merges into a first minor portion of the male rotor primary flank.

32. A pair of rotors as claimed in claim 31 in which said first minor portion of the male rotor primary flank merges into said major portion of the male rotor secondary flank at the land tip.

* * * * *